US006612237B2

(12) United States Patent
Derhardt et al.

(10) Patent No.: US 6,612,237 B2
(45) Date of Patent: Sep. 2, 2003

(54) METHOD OF OPERATING A SHEET-FED ROTARY PRINTING MACHINE, AND SHEET-FED ROTARY PRINTING MACHINE

(75) Inventors: Steffen Derhardt, Heidelberg (DE); Karl-Heinz Helmstädter, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/998,708

(22) Filed: Nov. 30, 2001

(65) Prior Publication Data

US 2002/0073858 A1 Jun. 20, 2002

(30) Foreign Application Priority Data

Nov. 30, 2000 (DE) ..... 100 59 590

(51) Int. Cl.[7] ..... B41F 13/24
(52) U.S. Cl. ..... 101/247; 101/144; 101/218
(58) Field of Search ..... 101/142, 144, 101/216, 217, 218, 247, 248, 485, 486, 479

(56) References Cited

U.S. PATENT DOCUMENTS

| | | | | |
|---|---|---|---|---|
| 3,744,760 A | * | 7/1973 | Uher | 254/351 |
| 3,992,991 A | * | 11/1976 | Koch | 101/132 |
| 4,782,717 A | | 11/1988 | Becker | |
| 5,123,507 A | * | 6/1992 | Carlson et al. | 192/14 |
| 5,148,715 A | * | 9/1992 | Blaser et al. | 74/325 |
| 5,265,528 A | | 11/1993 | Mathes | |
| 5,331,890 A | | 7/1994 | Miyoshi et al. | |
| 5,365,845 A | | 11/1994 | Becker | |
| 5,410,959 A | * | 5/1995 | Sugiyama et al. | 101/230 |
| 5,570,634 A | * | 11/1996 | Harter | 101/375 |
| 5,642,668 A | * | 7/1997 | Schaede et al. | 101/415.1 |
| 5,701,818 A | * | 12/1997 | Mohrmann | 101/375 |
| 5,704,288 A | | 1/1998 | John | |
| 6,308,620 B1 | | 10/2001 | Wadlinger et al. | |

FOREIGN PATENT DOCUMENTS

| | | |
|---|---|---|
| DE | 426635 | 11/1924 |
| DE | 36 11 324 C2 | 12/1988 |
| DE | 36 11 325 C2 | 7/1991 |
| DE | 42 18 071 A1 | 5/1993 |
| DE | 41 41 817 C2 | 10/1993 |
| DE | 42 23 190 A1 | 1/1994 |
| DE | 42 14 228 C2 | 2/1994 |
| DE | 44 35 226 A1 | 4/1996 |
| EP | 0 878 301 A2 | 11/1998 |

* cited by examiner

*Primary Examiner*—Stephen R. Funk
*Assistant Examiner*—Jill E Culler
(74) *Attorney, Agent, or Firm*—Laurence A. Greenberg; Werner H. Stemer; Ralph E. Locher

(57) ABSTRACT

A method of operating a sheet-fed rotary printing machine includes mounting at least one rotating cylinder to be coupled to a drive or fixed relative to a framework, and moving an actuator to both uncouple the cylinder from the drive and fix the cylinder relative to the framework. A sheet-fed rotary printing machine includes a framework, a drive, at least one cylinder rotatably mounted to the framework, the cylinder is to be coupled to the drive or fixed relative to the framework, and a fixing and coupling configuration connected to the cylinder to both uncouple the cylinder from the drive and fix the cylinder relative to the framework.

36 Claims, 10 Drawing Sheets

METHOD OF OPERATING A SHEET-FED ROTARY PRINTING MACHINE, AND SHEET-FED ROTARY PRINTING MACHINE

BACKGROUND OF THE INVENTION

Field of the Invention

The invention relates to a method of operating a sheet-fed rotary printing machine and to a sheet-fed rotary printing machine having a framework by which at least one cylinder is mounted in a rotatable manner. It is possible for the cylinder to be coupled to a drive or fixed relative to the framework.

Such a method and such a sheet-fed rotary printing machine are disclosed in European Patent Application EP 0 878 301, corresponding to U.S. Pat. No. 6,308,620 B1 to Wadlinger et al. The cylinder is, for example, a varnishing cylinder of a varnishing unit. During operation of the sheet-fed rotary printing machine, the cylinder interacts with an impression cylinder to print a printing-material sheet that is guided through between the cylinder and impression cylinder.

During printing operation of multi-color sheet-fed printing machines, which may have a varnishing unit disposed downstream of them, the transported sheets are only printed with ink in the first printing units. Subsequent printing units or varnishing units idle along therewith. The corresponding impression cylinders are spaced apart from the associated varnishing cylinder. The configuration produces, between the cylinder and impression cylinder, a small gap through which the previously printed sheets are transported. The high machine speed causes the sheets to lift off from an impression cylinder and strike against the associated cylinder.

In order to make possible smear-free sheet travel with printing, varnishing or finishing units switched off, Wadlinger proposes the formation, on or in the cylinder, of a sheet-directing configuration by which a sheet that is transported past the associated cylinder by the respective impression cylinder is kept away from the cylinder. The sheet-directing configuration is accommodated, for example, in a channel that runs axially in the lateral surface of the cylinder. A blowing tube that is connected to a blowing-air connection on the cylinder end side forms, for example, the sheet-directing configuration. The blowing air passing out of the blowing tube serves for forcing away from the cylinder, in the direction of the associated impression cylinder, a sheet that is transported through between the cylinder and the impression cylinder.

To ensure satisfactory functioning of the sheet-directing configuration, it is necessary for the cylinder to be uncoupled from the associated drive and fixed in a specific angular position relative to the framework. According to Wadlinger, the cylinder is uncoupled from the drive by a coupling and fixed relative to the machine framework by a catch.

SUMMARY OF THE INVENTION

It is accordingly an object of the invention to provide a method of operating a sheet-fed rotary printing machine having a framework by which at least one cylinder is rotatably mounted and sheet-fed rotary printing machine for implementing the method that overcomes the hereinafore-mentioned disadvantages of the heretofore-known devices and methods of this general type and that make it possible for the cylinder to be straightforwardly uncoupled from the drive and/or fixed relative to the framework. Another objective is for the method to be cost-effective to implement and for the sheet-fed rotary printing machine according to the invention to be cost-effective to produce.

With the foregoing and other objects in view, there is provided, in accordance with the invention, a method of operating a sheet-fed rotary printing machine, including the steps of mounting at least one rotating cylinder to be selectively coupled to a drive and fixed relative to a framework and moving an actuator to both uncouple the cylinder from the drive and fix the cylinder relative to the framework.

Simply by movement of an actuating element or actuating member, the cylinder is both uncoupled from the drive and fixed relative to the framework and vice-versa. The method and configuration give the advantage that, following the uncoupling operation, the cylinder is automatically and reliably fixed relative to the framework. Instead of a coupling and a catch, all that is required is for a single actuating element to be moved.

In accordance with another mode of the invention, the cylinder is made to rotate in the circumferential direction by the movement of the actuating element, in particular, displacement of the actuating element parallel to the longitudinal axis of the cylinder. The specific rotation of the cylinder through a few degrees serves for adjusting the circumferential register. It is particularly practical if the movement of a single actuating element is used for coupling and fixing purposes and for adjusting the circumferential register. Preferably, the actuator is an actuating element or an actuating member.

With the objects of the invention in view, there is also provided a sheet-fed rotary printing machine, including a framework, a drive, at least one cylinder rotatably mounted to the framework, the cylinder to be coupled to the drive or fixed relative to the framework, and a fixing and coupling configuration connected to the cylinder to both uncouple the cylinder from the drive and fix the cylinder relative to the framework. The fixing and coupling configuration both uncoupled the cylinder from the drive and fixes it relative to the framework and vice-versa. Prior to uncoupling from the drive, the cylinder is stopped in a defined angle position by the drive itself. The combined fixing and coupling configuration allows reliable uncoupling and fixing of the cylinder in a straightforward manner.

In accordance with a further feature of the invention, the fixing and coupling configuration includes an actuating element that can be displaced parallel to the longitudinal axis of the cylinder. The axial displacement of the actuating element serves for uncoupling and fixing the cylinder and for adjusting the circumferential register.

In accordance with an added feature of the invention, there is provided an actuating gearwheel that is fixed axially, and mounted rotatably, on the actuating element, coaxially with the cylinder, and engages with a driving gearwheel. Through the actuating gearwheel, the driving torque of the driving gearwheel is transmitted to the cylinder either directly or through the actuating element. The rotatable mounting ensures that the actuating gearwheel runs along with the driving gearwheel when the cylinder is fixed relative to the framework and that the driving gearwheel rotates.

In accordance with an additional feature of the invention, the actuating element or an actuating member that can be moved relative thereto can be displaced axially between a coupling position, in which the cylinder is coupled to the drive, and a fixing position, in which the cylinder is fixed relative to the framework. The axial displacement of the actuating element or of the actuating member takes place directly or indirectly by an actuating motor.

In accordance with yet another feature of the invention, in the coupling position of the actuating element or of the actuating member, the actuating gearwheel is connected to the cylinder in a form-fitting manner, through a first form-fitting element, directly or indirectly through the actuating element. The form-fitting connection between the actuating gearwheel and the cylinder ensures that the cylinder is driven during printing operation. The form fit prevents the actuating gearwheel and the cylinder from rotating relative to one another, which could have an adverse effect on the circumferential register during operation.

A further preferred exemplary embodiment of the sheet-fed rotary printing machine is characterized in that the first form-fitting element includes a bolt that is fitted on the actuating gearwheel and, in the coupling position of the actuating element, is at least partially accommodated in a bore that is provided at the end of a flange or of an arm that is provided on the cylinder. The bolt may be formed integrally with the actuating gearwheel. As a result of the above-described axial fixing of the actuating gearwheel on the actuating element, axial displacement of the actuating element is transmitted to the bolt.

In accordance with yet an added feature of the invention, the first form-fitting element includes a bolt that is prestressed by a spring, is fitted on the actuating element or the actuating member, and, in the coupling position of the actuating element or the actuating member, is at least partially accommodated in a bore that is provided in the actuating gearwheel. By virtue of the spring prestressing of the bolt, the cylinder remains coupled to the driving gearwheel even in the event of an auxiliary-power failure.

In accordance with yet an additional feature of the invention, in the fixing position, the actuating element is connected to the framework through a second form-fitting element. The form-fitting connection between the cylinder and framework ensures that the cylinder is at a precise angle in the fixing position. The configuration makes it possible for a sheet-directing configuration disposed on or in the cylinder to be positioned precisely in relation to an associated impression cylinder.

In accordance with again another feature of the invention, the second form-fitting element includes a bolt that is provided on the actuating element or the actuating member and, in the fixing position of the actuating element or of the actuating member, is at least partially accommodated in a bore that is provided on the framework. To ensure a clear angular relationship between the actuating gearwheel and the cylinder and/or between the cylinder and the framework, only one bolt or protrusion is provided in each case for the form-fitting connection between the actuating gearwheel and the cylinder and/or between the cylinder and the framework. It is also possible, however, for a plurality of bolts or protrusions to be disposed on concentric circles with different radii or for a plurality of bolts or protrusions to be disposed asymmetrically on one circle. Finally, it is also possible to use a plurality of bolts or protrusions that differ from one another in terms of size and shape. The bolts or protrusions and the associated bores or recesses are constructed to complement one another in each case to ensure a form fit between the respective parts.

In accordance with again a further feature of the invention, the second form-fitting element is connected, in particular integrally, to the first form-fitting element and, in the fixing position of the actuating element or of the actuating member, is retained on the framework by a latching configuration. The latching configuration ensures that, despite the spring's prestressing of the first form-fitting element in the opposite direction, the second form-fitting element remains connected to the framework, to be precise, even in the event of an auxiliary-power failure.

In accordance with again an added feature of the invention, there is provided an actuating member mounted on the actuating element. The actuating member is provided with a first and a second form-fitting element and can be moved between a coupling position, in which the cylinder is connected to the actuating gearwheel in a rotationally fixed manner through the first form-fitting element, and a fixing position, in which the cylinder is connected to the framework in a rotationally fixed manner through the second form-fitting element. The actuating member makes it possible for the cylinder to be uncoupled and fixed. A slight rotation of the cylinder for the purpose of adjusting the circumferential register may take place through a defined adjustment, in particular, a slight axial displacement, of the actuating element.

In accordance with again an additional feature of the invention, the actuating member can be actuated by an actuating configuration and, in the non-actuated state, is retained in the coupling position or fixing position by at least one prestressed spring. As a result, the cylinder remains in its current state even in the event of an auxiliary-power failure.

In accordance with still another feature of the invention, the actuating member is formed by a lever that is fitted pivotably on the actuating element and at one end of which the first and the second form-fitting elements are disposed on opposite sides with respect to one another. The configuration allows a quick switchover between the fixing and coupling positions.

In accordance with still a further feature of the invention, the actuating member is formed by a slide that is guided in a displaceable manner relative to the actuating element. The dimensioning of the slide and of the complementary recesses in the cylinder, the actuating gearwheel, and the framework makes it possible to prevent the cylinder from rotating during the switchover between the fixing and coupling positions. For such a purpose, the slide has to be long enough for the cylinder briefly to be connected in a form-fitting manner both to the actuating gearwheel and to the framework.

In accordance with still an added feature of the invention, the cylinder can be fixed relative to the framework by a further actuating element. The further actuating element serves for fixing the cylinder irrespective of the position of the first actuating element. In the exemplary embodiment, the first actuating element, thus, serves only for coupling the cylinder to the actuating gearwheel and for retaining the circumferential register.

In accordance with still an additional feature of the invention, the further actuating element is formed by a slide that is guided on the framework and, for the purpose of fixing the cylinder, can engage at least partially in a recess that is formed on a flange or an arm of the cylinder. Instead of the slide, it is also possible to use a lever that is provided, at one end, with a form-fitting element that can engage in the recess formed on the cylinder.

In accordance with another feature of the invention, the further actuating element is mounted such that it can he displaced radially and such that it is resilient tangentially to the cylinder. The resilient mounting in the direction transverse to the adjusting direction of the actuating element serves for compensating for positioning inaccuracies during the switchover operation.

In accordance with a further feature of the invention, the fixing and coupling configuration includes a first additional actuating element, which serves for fixing the original actuating element relative to the framework, and a second additional actuating element, which serves for coupling the actuating element to the actuating gearwheel. The two additional actuating elements may be coupled to one another through a control configuration to ensure a disruption-free switchover between a fixing position and a coupling position of the cylinder. In the exemplary embodiment, the original actuating element serves for retaining the circumferential register.

In accordance with an added feature of the invention, the first and the second additional actuating elements each include a form-fitting element, which can be accommodated in corresponding recesses in the original actuating element and the actuating gearwheel. The two form-fitting elements ensure that rotation of the cylinder and framework relative to one another in the fixing position and rotation of the cylinder and actuating gearwheel relative to one another in the coupling position are reliably prevented. To counteract relative rotation during the switchover operation, the two form-fitting elements may simultaneously engage with their complementary recess for a short period of time.

In accordance with an additional feature of the invention, the actuating element is connected to the cylinder in a rotationally fixed manner through a form-fitting element, for example, a feather key or a toothing formation, in particular, a straight toothing formation. The configuration ensures, in particular, in the fixing position, that the cylinder is fixed in a defined angle position. At the same time, the rotatable mounting of the actuating gearwheel on the actuating element ensures that the actuating gearwheel, which engages with the driving gearwheel on a permanent basis, can rotate during operation.

In accordance with yet another feature of the invention, the actuating gearwheel and the driving gearwheel are provided with an oblique toothing formation. Accordingly, axial displacement of the actuating element causes the cylinder, coupled to the actuating element in a rotationally fixed manner, to rotate in order for the circumferential register to be adjusted. The axial displacement of the actuating element and the rotation of the cylinder only take place to a small extent. The coupling between the actuating element and the cylinder may take place, for example, by a feather key or a straight toothing formation. The configuration ensures that the actuating element can be displaced axially relative to the cylinder.

In accordance with yet a further feature of the invention, the actuating element is subjected to the action of a threaded bolt that, driven rotatably by a motor, is accommodated in a threaded bore that is provided in a flange that is connected to the framework in a rotationally fixed manner. Through the threaded bolt, the rotary movement of the motor is converted into a translatory movement of the flange, which is coupled to the actuating element. An axial bearing is preferably in provided between the flange and the actuating element to make it possible for the actuating element and the cylinder to rotate relative to the flange as far as possible without friction.

In accordance with yet an added feature of the invention, the actuating element is prestressed by a spring. The spring prestressing holds the actuating element in abutment against the flange.

In accordance with yet an additional feature of the invention, the threaded bolt has a self-locking thread. The self-locking ensures, in conjunction with the spring's prestressing, that the threaded bolt remains in its respective position in the event of an auxiliary-power failure. This means that an undesired coupling operation does not take place.

In accordance with again another feature of the invention, there is provided a bevel formed on the bolt. The bevel serves for compensating for positioning inaccuracies during coupling and fixing of the cylinder. The form-fitting counterpart to the bolt is preferably provided with a complementary funnel-shaped widening.

In accordance with a concomitant feature of the invention, the actuating gearwheel is braced in relation to the driving gearwheel by a clamping gearwheel. The configuration ensures play-free force transmission between the driving gearwheel and the cylinder during printing operation.

Other features that are considered as characteristic for the invention are set forth in the appended claims.

Although the invention is illustrated and described herein as embodied in a method of operating a sheet-fed rotary printing machine and sheet-fed rotary printing machine, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
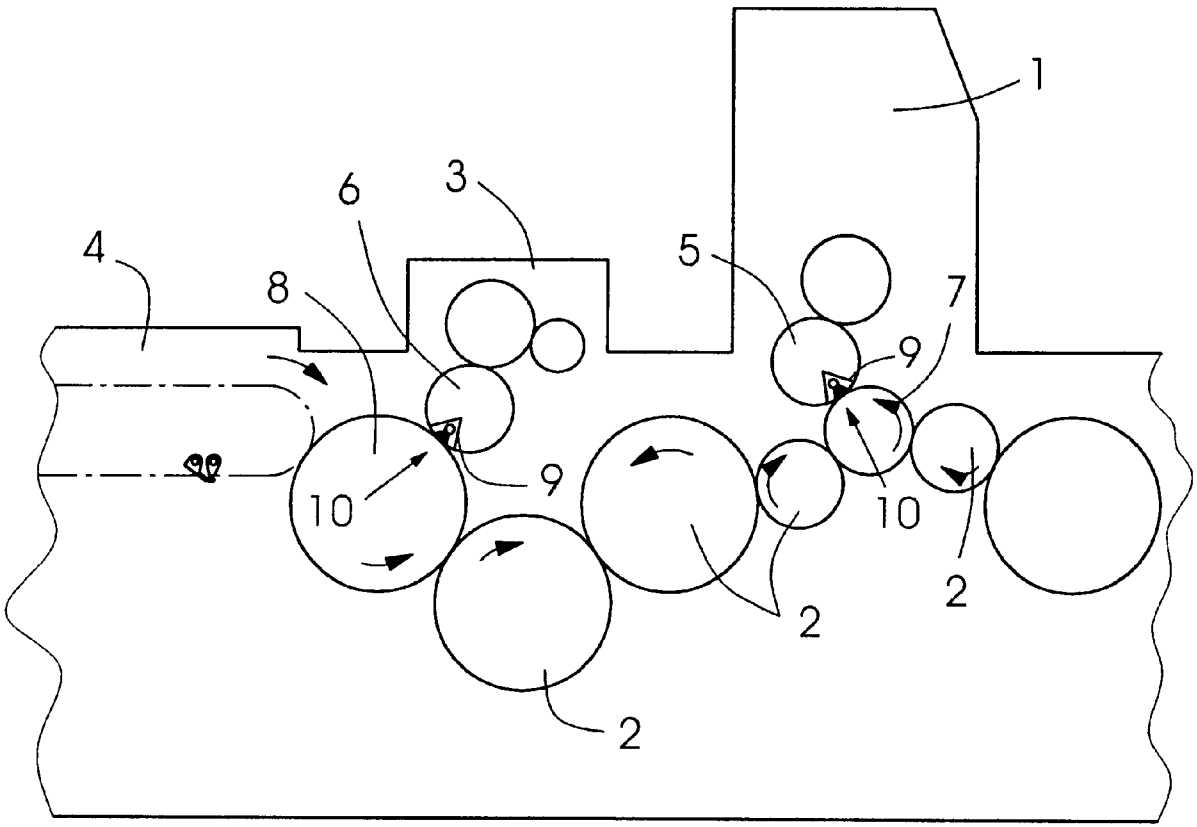
FIG. 1 is a fragmentary, cross-sectional view of part of a multicolor sheet-fed rotary printing machine according to the invention.

Referring now to the figures of the drawings in detail and first, particularly to FIG. 1 thereof, there is shown part of a multi-color sheet-fed rotary printing machine. Sheets have already been printed by upstream non-illustrated printing units, and are fed to a printing unit 1 that has been switched off. From here, the printed sheets are transported, by transfer drums 2, through a varnishing unit 3, which is not involved in the printing operation either, and are then fed to a sheet-delivery device 4. In the illustrated case, a printing-blanket cylinder 5 and a varnishing-blanket cylinder 6 have been withdrawn from an associated impression cylinder 7, 8. The printing-blanket cylinder 5 and the varnishing-blanket cylinder 6 have cylinder channels 9, in which blanket-tensioners are provided in a conventional manner.

Provided in the cylinder channels 9 of the printing-blanket cylinder 5 and varnishing-blanket cylinder 6 are sheet-directing elements 10, which may be constructed as directing plates and/or directing tongues. The directing plates and/or directing tongues 10 can be inserted into the cylinder channels 9 and fastened here. As a result, for example, during the operation of printing stiff cardboard, the trailing sheet edge can slide along the directing plates and/or directing tongues without the imprint being damaged.

The sheet-directing elements 10 may also be configured as blowing tubes that can be coupled to blowing-air connections on the cylinder end side. The blowing tubes 10 can discharge a vertical air stream onto the sheets that are to be transported, and achieve the highest contact-pressure force as a result. The blowing air of the blowing tubes is directed perpendicularly onto the sheets transported by the respective impression cylinders 7, 8, with the result that the sheets are forced down onto the respective impression cylinders 7, 8 without coming into contact with parts of the printing-blanket cylinder 5 or varnishing-blanket cylinder 6. To ensure satisfactory functioning of the sheet-directing elements, the printing-blanket cylinder 5 and the varnishing-blanket cylinder 6 have to be positioned at a defined angle. The positioning can be achieved by securing the printing-blanket cylinder 5 and the varnishing-blanket cylinder 6 on a side wall of the sheet-fed rotary printing machine. The printing-blanket cylinder 5 and the varnishing-blanket cylinder 6 have to be uncoupled from their drive at the same time.

Figure 2:
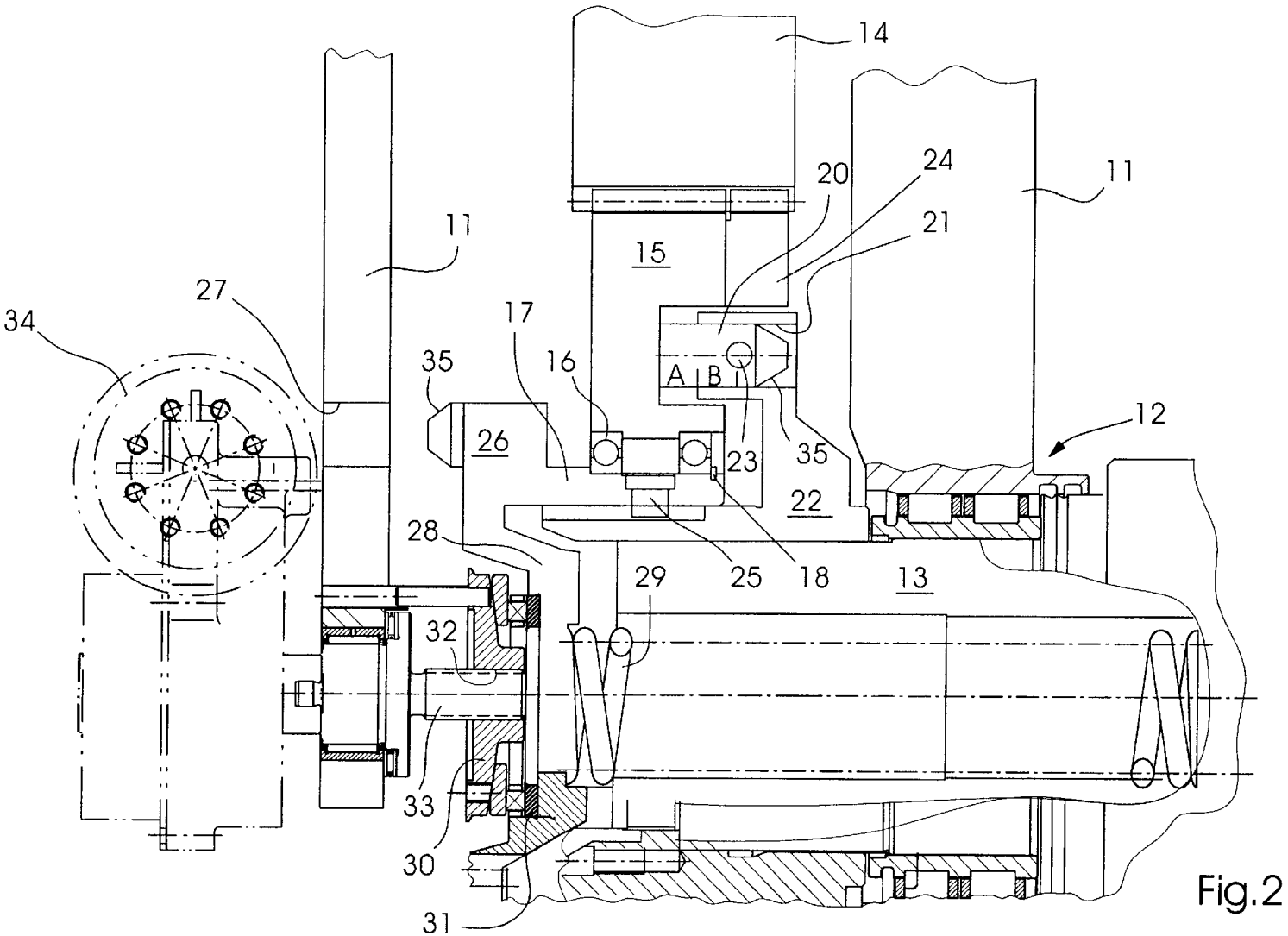
FIG. 2 is a fragmentary, cross-sectional view of a first embodiment of the sheet-fed rotary printing machine of FIG. 1, FIGS. 3 to 7 are enlarged, cross-sectional view of form-fitting elements of FIG. 2 in different switching states.

FIG. 2 shows a framework 11 with a mounting 12 for a cylinder 13. The cylinder 13 is, for example, the printing-blanket cylinder 5 or varnishing-blanket cylinder 6 of the sheet-fed rotary printing machine illustrated in FIG. 1. The mounting 12 ensures that the cylinder 13 can rotate during operation. The rotary movement of the cylinder 13 is produced by a driving gearwheel 14 that can be coupled to the cylinder 13 through an actuating gearwheel 15. The actuating gearwheel 15 is mounted rotatably on an actuating element 17 by a mounting 16. The mounting 16 is formed by two radial ball bearings. The actuating gearwheel 15 is fixed axially on the actuating element 17 by a ring 18, which is accommodated in a circumferential groove of the actuating element 17 and projects out of the groove.

A bolt 20 is formed on the actuating gearwheel 15 and extends parallel to the longitudinal axis of the cylinder 13. The bolt 20 is partially accommodated in a bore 21 that is provided at the end of an arm 22 such that it likewise runs parallel to the longitudinal axis of the cylinder 13. The arm extends radially from the cylinder 13. The bolt 20 accommodated in the bore 21 produces a form-fitting connection between the actuating gearwheel 15 and the cylinder 13. A spring prestressing configuration 23 compensates for any possible play between the bolt 20 and the bore 21. In order to realize play-free force transmission between the driving gearwheel 14 and the cylinder 13 during printing, the actuating gearwheel 15 is braced in relation to the driving gearwheel 14 by a clamping gearwheel 24.

In the region of the mounting 16, the actuating element 17 is in the form of a circular-cylindrical sleeve that is connected to the cylinder 13 in a rotationally fixed manner through a feather key 25. The feather key 25 makes it possible for the actuating element 17 to be displaced axially relative to the cylinder 13.

If the actuating element 17 is displaced axially (in relation to the cylinder 13) in the direction of the framework 11 from the position illustrated in FIG. 2, then the actuating gearwheel 15, with the bolt 20, is displaced to the same extent as a result of the axial fixing by the ring 18. The bolt 20 is, thus, drawn out of the bore 21. At the same time, a bolt 26, which is formed on the actuating element 17 and runs parallel to the longitudinal axis of the cylinder 13, moves toward a bore 27, which is provided in the framework 11. The dimensions of the bolts 20 and 26 and the spacings between the bolts 20, 26 and the bores 21, 27 are selected in each case such that the bolt 26 engages in the bore 27 before the it bolt 20 has moved out of the bore 21 to the full extent. As such, during displacement of the actuating element 17, it is always ensured that at least one of the bolts 20, 26 is accommodated in the associated bore 21, 27.

The position of the actuating element 17 that is illustrated in FIG. 2, and in which the actuating gearwheel 15 is connected to the cylinder 13 in a form-fitting manner through the bolt 20 and the arm 22, is referred to as the coupling position. A form-fitting or form-locking connection is one that connects two elements together due to the shape of the elements themselves, as opposed to a force-locking connection, which locks the elements together by force external to the elements. In the coupling position, the cylinder 13 is driven by the driving gearwheel 14. The driving gearwheel 14 is coupled to the non-illustrated main drive of the sheet-fed rotary printing machine. The cylinder 13 can be stopped in a specific angle position through the main drive to give the correct positioning of a channel, disposed in the cylinder 13, with a blowing-air tube. As long as the driving gearwheel 14 is at a standstill, the actuating element 17 can be displaced parallel to the longitudinal axis of the cylinder 13 until the bolt 26 is accommodated in the bore 27 on the framework 11. In the so-called fixing position (which is not illustrated in FIG. 2), the actuating element 17 is connected to the framework 11 in a form-fitting manner. In the fixing position, the feather key 25 ensures that the cylinder 13 maintains its precisely defined angle position. At the same time, the mounting 16 ensures that the actuating gearwheel 15 can rotate relative to the actuating element 17. In the fixing position, the bolt 20, formed on the actuating gearwheel 15, is no longer accommodated in the bore 21, which is formed on the cylinder arm 22. If the driving gearwheel 14, then, is made to rotate again through the main drive, the actuating gearwheel 15 rotates along therewith without its movement being transmitted to the actuating element 17 or the cylinder 13.

The driving gearwheel 14 and the actuating gearwheel 15 also engage with one another throughout the operation of switching over between the coupling position and fixing position. The engagement has the advantage that any possible damage that could occur during the inter-engagement of the two gearwheels 14, 15 is avoided. The permanent engagement of the gearwheels 14, 15 maintains a constant rotary-angle relationship. As a result, it is possible for the cylinder 13 to be positioned precisely through the driving gearwheel 14.

An arm 28 extends radially inward from the actuating element 17. On a side that is directed toward the cylinder 13, the arm 28 is subjected to the action of a compressively prestressed spring 29, the majority of which is disposed in the interior of the cylinder 13. On a side of the arm 28 that is directed away from the cylinder 13, a flange 30 is fixed to the framework 11. Provided between the flange 30 and the arm 28 is an axial bearing 31, which makes it possible for the actuating element 17 to be rotated relative to the flange 30. The flange 30 is provided with a central bore 32 with a non-illustrated internal thread. The internal thread of the bore 32 interacts with the non-illustrated external thread of a bolt 33, which can be made to rotate specifically by an actuating motor 34. The end surface formed at the free end of the bolt 33 butts against the arm 28.

Rotation of the threaded bolt 33 results in axial displacement of the flange 30 relative to the threaded bolt 33. The axial displacement of the flange 30 is transmitted to the actuating element 17. The dimensions of the relevant components are selected such that further axial displacement of the actuating element 17 is possible to ensure that the bolt 26 can also engage in the bore 27 of the framework 11. The arm 28 is in permanent abutment against the flange 30, even during the axial displacement of the actuating element 17 in the direction of the framework 11.

The actuating element 17 makes it possible for the cylinder 13, during uncoupling from the driving gearwheel 14, to be simultaneously secured in a predetermined position on the framework 11. Only an angular relationship is admissible between the driving gearwheel 14 and the cylinder 13. During the switchover between the fixing position and the coupling position, the actuating element 17 is displaced in an axis-parallel manner to the cylinder 13 by the actuating motor 34, through the threaded bolt 33. Due to the mounting 16, the actuating gearwheel 15 is moved along correspondingly.

The bolt 20 engages with the cylinder 13 during printing operation. When the printing machine is at a standstill, displacement of the actuating element 17 releases the connection between the bolt 20 and the cylinder 13, and the bolt 26 comes into engagement with the framework 11. By virtue of the feather key 25, the cylinder 13 is, thus, secured on the framework 11. The actuating gearwheel 15 idles along during printing. The bolts 20 and 26 are disposed and dimensioned such that it is only possible to have an angular relationship between the actuating gearwheel 15 and the cylinder 13 and/or between the cylinder 13 and the framework 11. The construction is achieved by using only one bolt 20, 26 in each case to provide a form-fitting connection between the actuating gearwheel 15 and the cylinder 13 and/or the cylinder 13 and the framework 11. Alternatively, it is also possible to use a plurality of bolts that either are disposed a symmetrically on one and the same radius or are disposed on different radii. Furthermore, it is also possible to use a plurality of bolts that differ in terms of size and/or shape.

The thread of the bolt 33 has a self-locking configuration. Due to the self-lock in the threaded bolt 33 and of the prestressing force of the spring 29, it is ensured that the actuating element 17 remains in its current position even in the event of an auxiliary-power failure. An undesired coupling process, thus, does not take place.

A bevel 35 is formed on the bolts 20 and 26 in each case. The bevel 35 makes it possible to compensate for positioning inaccuracies of the main drive during the switchover from the fixing position to the coupling position and vice-versa.

The actuating gearwheel 15 is connected to the driving gearwheel 14 through an oblique toothing formation. When the driving gearwheel 14 is at a standstill, the oblique toothing formation, in the case of axial displacement of the actuating gearwheel 15, results in the actuating gearwheel 15 rotating slightly. Such rotation is transmitted to the cylinder 13 through the bolt 20 and can be utilized to adjust the circumferential register.

Sections A and B are marked on the bolt 20 and serve for rotating the cylinder 13 specifically through a few degrees. In the variant illustrated in FIG. 2, it is, thus, possible to use one and the same actuating element 17 both to adjust the circumferential register and to switch over between the fixing and coupling positions. The operations of switching over between the fixing and coupling positions and of retaining the circumferential register may be achieved by axial displacement of the actuating element 17 through just one actuating motor 34.

FIGS. 3 to 7 show the bolts 20 and 26 in different states during the switchover between the coupling position and the fixing position. In FIGS. 3 to 7, it is indicated that a funnel-shaped widening 36 is provided on the bore 27. In the same way, a funnel-shaped widening 37 is provided on the bore 21. The funnel-shaped widenings 36 and 37 interact with the respective bevel 35 that is formed on the bolts 20 and 26. By virtue of the interaction between the bevel 35 and the funnel-shaped widenings 36 and 37, it is possible to compensate for tolerances and positioning inaccuracies of the main drive during the switchover operation. During the switchover operation, the position of the cylinder 13 is oriented either in relation to the actuating gearwheel 15, which is positioned in a rotationally secured manner by the driving gearwheel 14 when the machine is at a standstill, or in relation to the framework 11.

Figure 3:
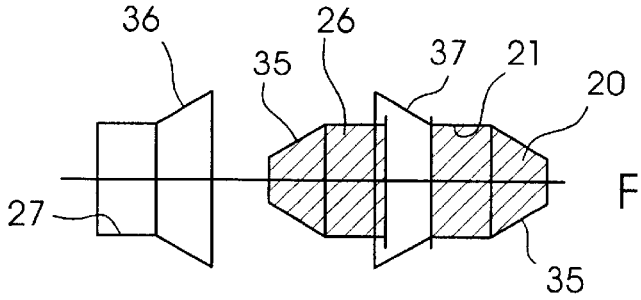

In FIG. 3, the bolt 20 is accommodated more or less entirely in the bore 21. Accordingly, the actuating gearwheel 15 engages with the cylinder 13. In such a case, the sheet-fed rotary printing machine is printing.

Figure 4:
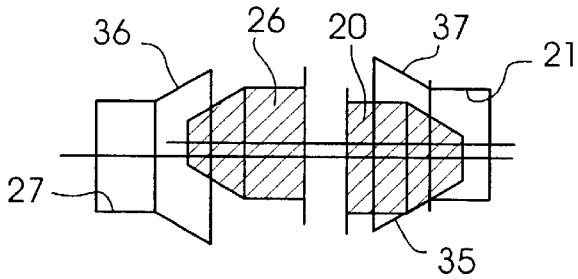

In FIG. 4, the sheet-fed rotary printing machine is at a standstill. The bolt 20 moves out of the bore 21 and the bolt 26 moves into the bore 27. In such a state, the bolts 20 and 26 butt, by way of their bevel 35, against the funnel-shaped widenings 36 and 37 of the associated bores. The action is achieved in that, in a position illustrated in FIG. 1, the cylinder 13, rather than being in equilibrium, tries to rotate to one side due to an imbalance caused by a channel of the cylinder 13.

Figure 5:
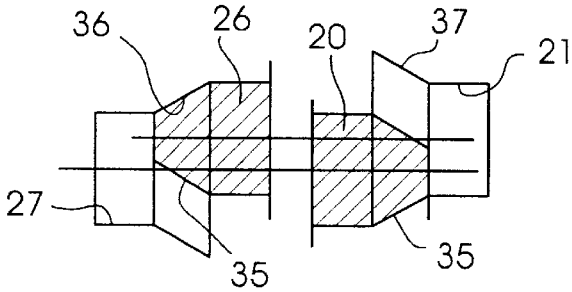

In the state illustrated in FIG. 5, the bolt 20 butts, by way of the bevel 35, against the funnel-shaped widening 37 of the bore 21. At the same time, the bolt 26 butts, by way of its bevel 35, against the funnel-shaped widening 36 of the bore 27.

Figure 6:
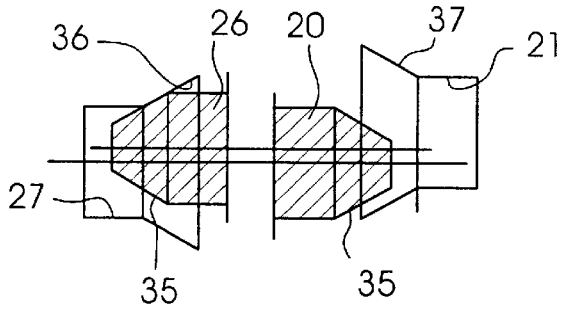

By virtue of the actuating element being displaced further in the direction of the framework, the bolt 26 moves further into the bore 27. Accordingly, in such a state, which is illustrated in FIG. 6, the bolt 26 and the framework determine the position of the cylinder 13.

Figure 7:
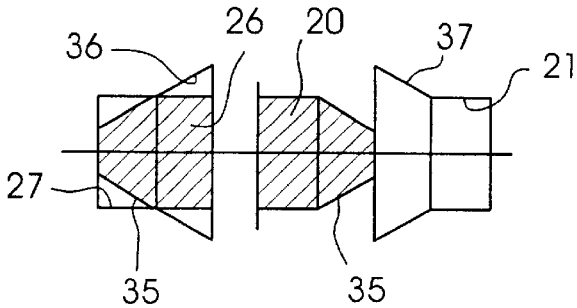

In FIG. 7, the actuating element 17 is located in its fixing position and the bolt 26 is accommodated entirely in the bore 27. At the same time, the bolt 20 has moved out of the bore 21 to the full extent. During displacement of the actuating element 17 from the fixing position into the coupling position and vice-versa, the cylinder 13 executes a small rotary movement due to the imbalance, caused by the cylinder channel, in the circumferential direction and due to the sliding-wedge action of the bevels 35.

Figure 8:
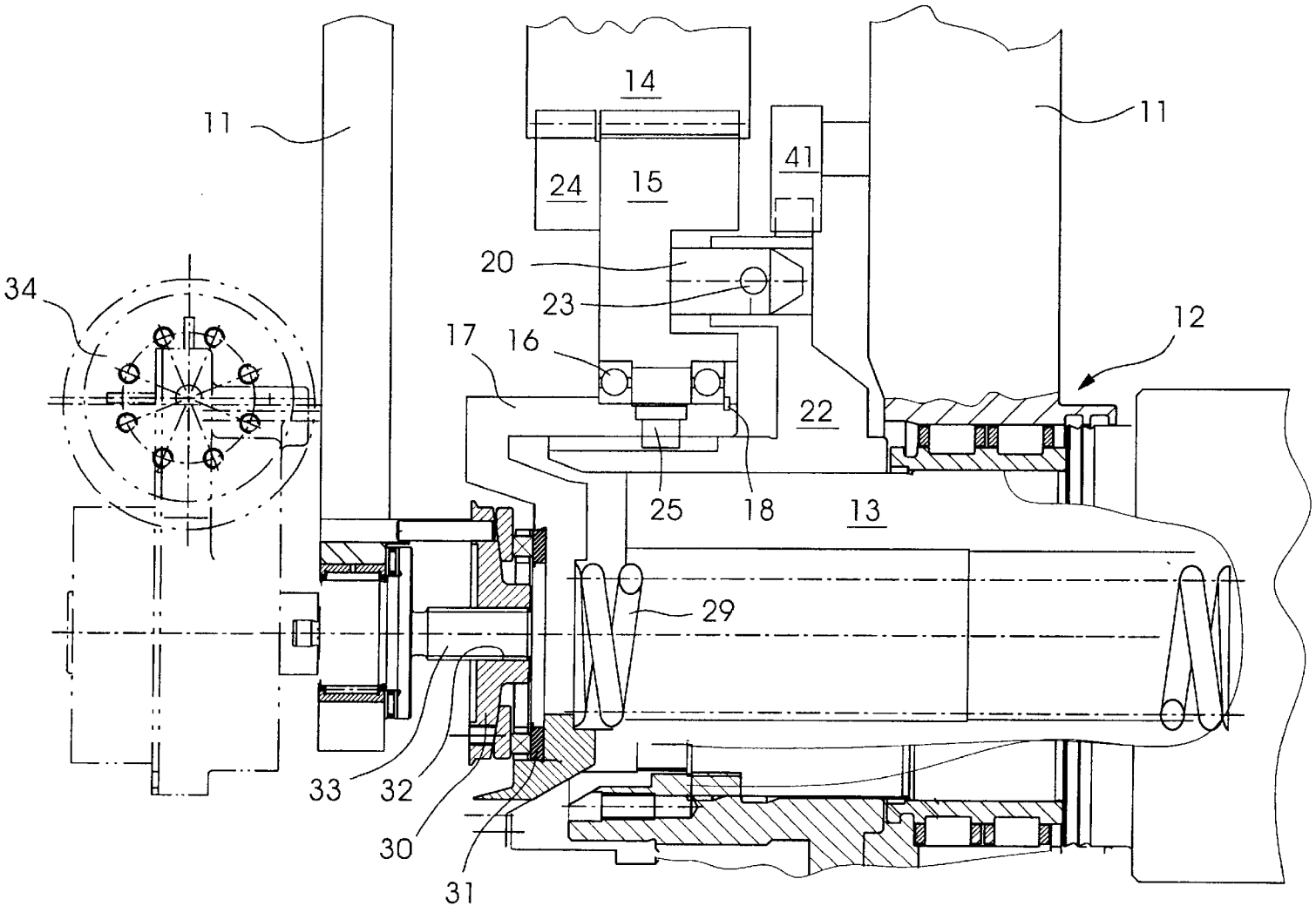
FIG. 8 is a fragmentary, cross-sectional view of a second embodiment of the sheet-fed rotary printing machine of FIG. 1.

A second variant is illustrated in FIG. 8 and is similar to the first variant illustrated in FIG. 2. Accordingly, the same parts are provided with the same designations. Thus, for descriptions of like part, reference is made to the description of FIG. 2. Only the differences between the two variants are discussed below.

In the second variant of FIG. 8, the operations of uncoupling the actuating gearwheel 15 from the cylinder 13 and retaining the circumferential register are achieved by axial displacement of the actuating element 17, as in the first variant (FIG. 2). In the second variant, however, there is no second form-fitting element fitted on the actuating element 17. Instead, in the second variant, the cylinder 13 is fixed relative to the framework 11 by a further actuating element 41 in the form of a radially moveable slide.

Figure 9:
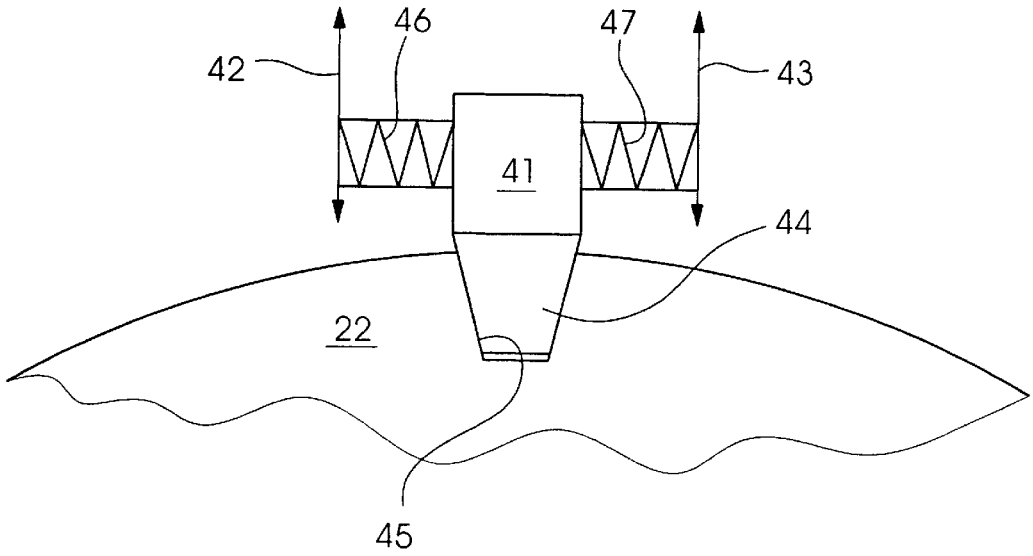
FIG. 9 is an enlarged, fragmentary, cross-sectional view of a form-fitting element of the sheet-fed rotary printing machine of FIG. 8.

The further actuating element 41 is illustrated in FIG. 9 on an enlarged scale. Double arrows 42 and 43 indicate that the further actuating element 41 can be moved back and forth in the radial direction in relation to the cylinder 13. A tip 44, which is in the form of an isosceles trapezoid in cross-section, is formed on the further actuating element 41. The tip 44 is accommodated in a recess 45 that is formed on the arm 22 of the cylinder 13. In the state illustrated in FIG. 9, the further actuating element 41, thus, engages with the arm 22 of the cylinder. As such, the cylinder is fixed on the framework. To compensate for any possible positioning inaccuracies of the main drive, the further actuating element 41 is mounted resiliently in the direction transverse to the adjusting direction 42, 43 by springs 46 and 47.

Figure 10:
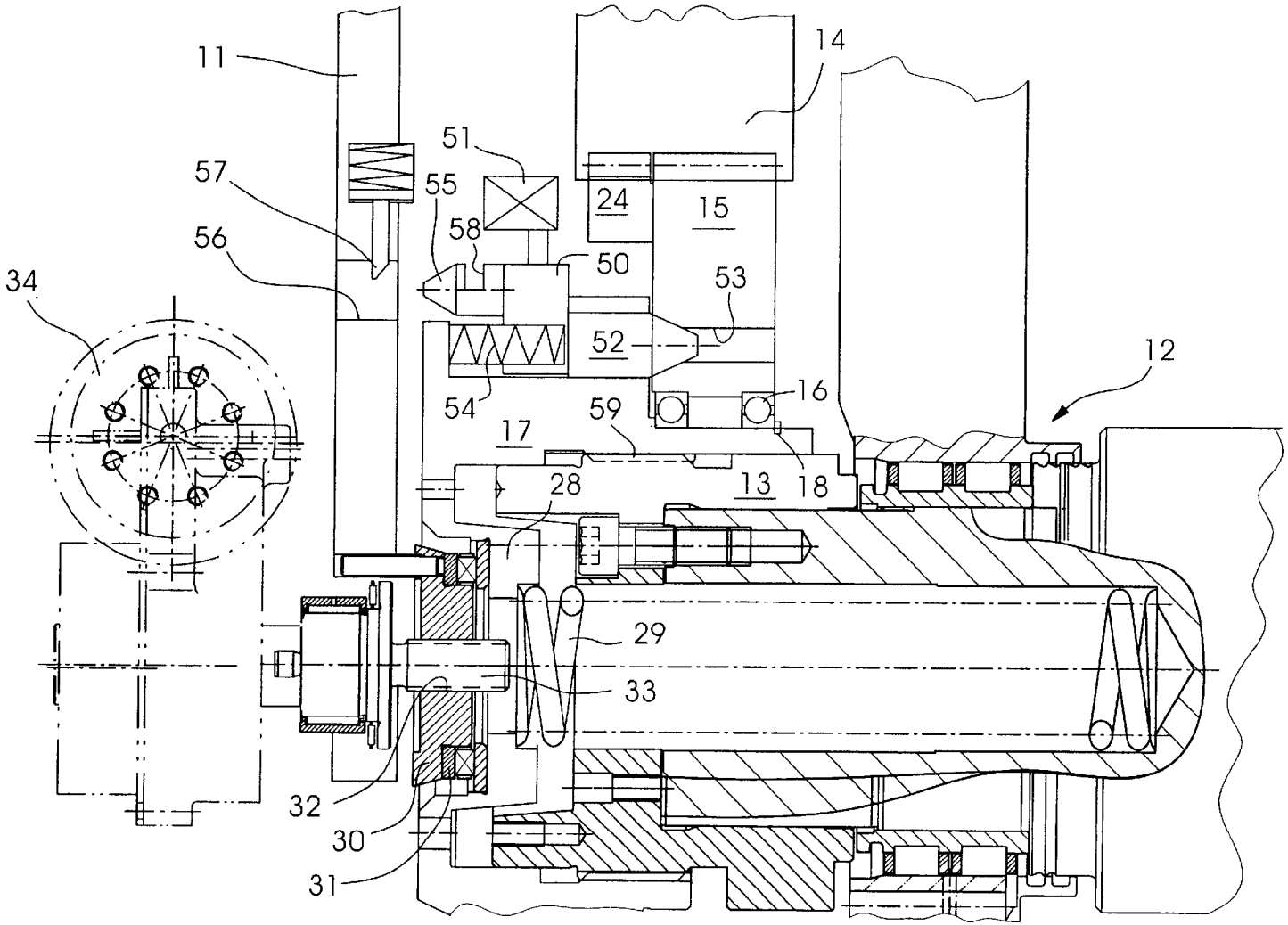
FIG. 10 is a fragmentary, cross-sectional view of a third embodiment of the sheet-fed rotary printing machine of FIG. 1.

A third variant is illustrated in FIG. 10 and is similar to the first variant illustrated in FIG. 2. The same parts are provided with the same designations. Thus, reference is made to the description relating to FIG. 2 for such like parts. To avoid repetition, only the differences between the two variants are discussed below.

In a third variant shown in FIG. 10 there is no form-fitting element fitted on either the actuating gearwheel 15 or the actuating element 17. Instead, an actuating member 50 is guided on the actuating element 17 such that it can be displaced parallel to the longitudinal axis of the cylinder 13. An actuating motor 51 displaces the actuating member 50. Formed on the actuating member 50 is a bolt 52, of which the longitudinal axis runs parallel to the longitudinal axis of the cylinder 13 and of which the tapering tip is accommodated in a bore 53 in the actuating gearwheel 15. A compressively prestressed spring 54 ensures that the actuating member 50 remains in the position illustrated in FIG. 10 even in the event of an auxiliary-power failure.

A bolt 55 is formed on the actuating member 50 on the side opposite to the bolt 52. The bolt 55 likewise extends parallel to the longitudinal axis of the cylinder 13 and, during axial displacement of the actuating member 50 in the direction of the framework 11, is accommodated in a bore 56 that is disposed in the framework 11. On the framework 11, moreover, a spring-prestressed catch 57 is guided such that it can be displaced perpendicularly to the longitudinal axis of the cylinder 13. The catch 57 can engage in a recess 58 in the bolt 55. Such a configuration ensures that, in the fixing position, the bolt 55 is retained in the bore 56 counter to the prestressing force of the spring 54. In a fixing position (which is not illustrated in FIG. 10), a straight toothing formation 59 provides a rotationally fixed connection between the actuating element 17 and the cylinder 13. The straight toothing formation 59, like the feather key 25 in the preceding variants, ensures axial displacement of the actuating element 17 on the cylinder 13.

In the third variant of FIG. 10, it is only the adjustment of the circumferential register that takes place by axial displacement of the actuating element 17. Axial displacement of the actuating member 50 performs the operation of switching over between the coupling and fixing positions. Accordingly, the actuating gearwheel 15 does not move during the switchover between the fixing and coupling positions. During a printing operation, which is illustrated in FIG. 10, the bolt 52 engages with the actuating gearwheel 15. The form-fitting connection is prestressed by the spring 54. Upon disengagement, the actuating member 50 is displaced axially, counter to the prestressing force of the spring 54, by the actuating motor 51 or a pneumatic cylinder until the bolt 55 engages in the framework 11 and the catch 57 latches into the recess 58. For re-coupling purposes, the catch 57 has to be released. The catch 57 may be replaced by a self-locking actuating element, such as an eccentric or a toggle lever.

The functioning of the circumferential register is achieved by axial displacement of the actuating element 17 in the third variant (FIG. 10) with the driving gearwheel 14 at a standstill.

In the event of an auxiliary-power failure, the bolt 52 remains in engagement with the actuating gearwheel 15 during printing operation due to the prestressing force of the spring 54. In a disengaged state, the actuating member 50 is secured by the catch 57 against undesired interengagement of the bolt 52 and the actuating gearwheel 15.

Figure 11:
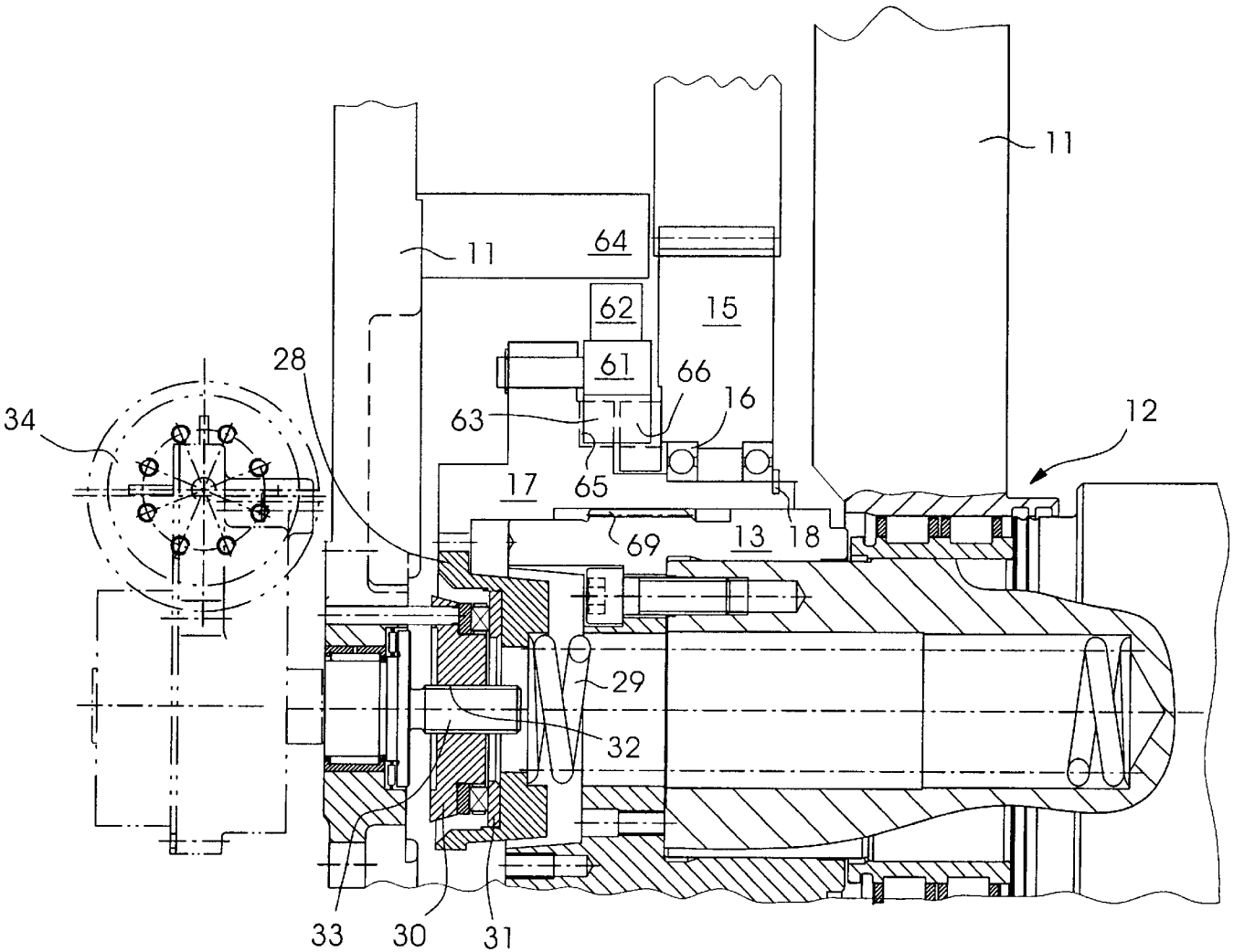
FIG. 11 is a fragmentary, cross-sectional view of a fourth embodiment of the sheet-fed rotary printing machine of FIG. 1.
Figure 12:
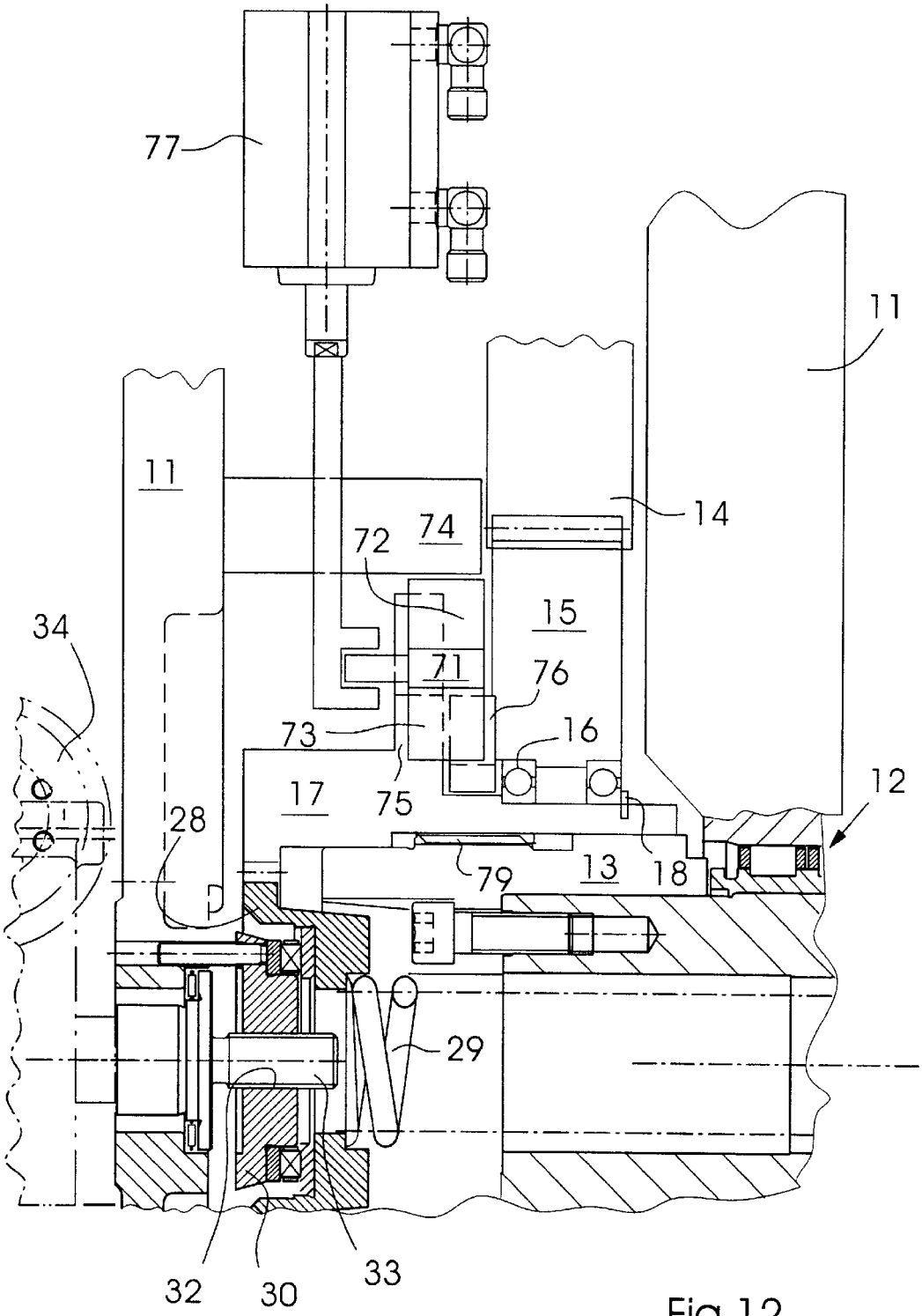
FIG. 12 is a fragmentary, cross-sectional view of a fifth embodiment of the sheet-fed rotary printing machine of FIG. 1.

Fourth and fifth variants of the invention are illustrated in FIGS. 11 and 12 and are similar to the first variant, which is illustrated in FIG. 2. The same parts are provided with the same designations. Thus, reference is made to the description of FIG. 2 for such parts. To avoid repetition, only the differences between the individual variants are discussed below.

In the fourth variant, illustrated in FIG. 11, an actuating member 61 is mounted pivotably on the actuating element 17. A first form-fitting element 62 and a second form-fitting element 63 are formed on the actuating member 61. The first form-fitting element 62 can engage in a recess 64 that is provided in the framework 11. The second form-fitting element 63 can engage simultaneously in a recess 65, which is made in the actuating element 17, and in a recess 66, which is formed in the actuating gearwheel 15.

Figure 13:
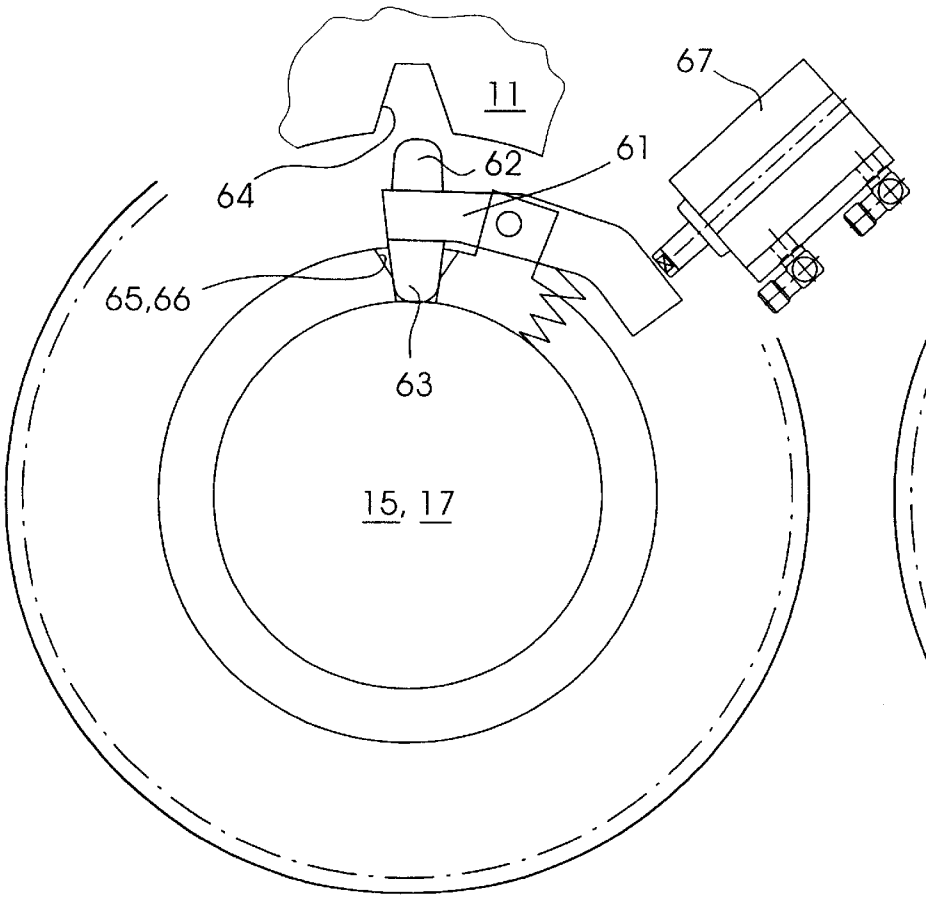
FIG. 13 is an enlarged, fragmentary, cross-sectional view of form-fitting elements of the sheet-fed rotary printing machine of FIG. 11.

FIG. 13 is an enlarged, side view of the actuating member 61. As can be seen, the actuating member 61 is formed by a spring-prestressed lever that is mounted, more or less in the center, pivotably on the actuating element 17. At one end of the lever, a first form-fitting element 62 and a second form-fitting element 63 are formed on opposite sides with respect to one another. The first form-fitting element 62 can engage in a recess 64 that is provided on the framework 11. The second form-fitting element 63 engages simultaneously in a recess 65, which is made on the actuating element 17, and in a recess 66, which is made on the actuating gearwheel 15. An actuating motor 67 or a pneumatic cylinder, which serves for actuating the actuating member 61, is disposed at the other end of the lever arm.

In the fourth variant of FIG. 11, the operation of switching over between the coupling and fixing positions is achieved by the actuating member 61. During printing operation, the form-fitting element 63 engages in the recesses 65 and 66 and, thus, provides a form-fitting connection between the actuating element 17 and the actuating gearwheel 15. A straight toothing formation 69 ensures a rotationally fixed connection between the actuating element 17 and the cylinder 13. In a fixing position (not illustrated in FIGS. 11 and 13), the actuating member 61, with the form-fitting element 62, ensures that the actuating element 17 is fixed relative to the framework 11. In the fixing position, the straight toothing formation 69 prevents a rotary movement of the cylinder 13. If the actuating element 17 is displaced axially by the actuating motor 34, through the threaded bolt 33, it is possible for the cylinder 13, as a result of the interaction of the oblique toothing formation between the driving gearwheel 14 and the actuating gearwheel 15 with the straight toothing formation 69 between the actuating element 17 and the cylinder 13, to be rotated in a defined manner through a few degrees to retain the circumferential register.

Figure 14:
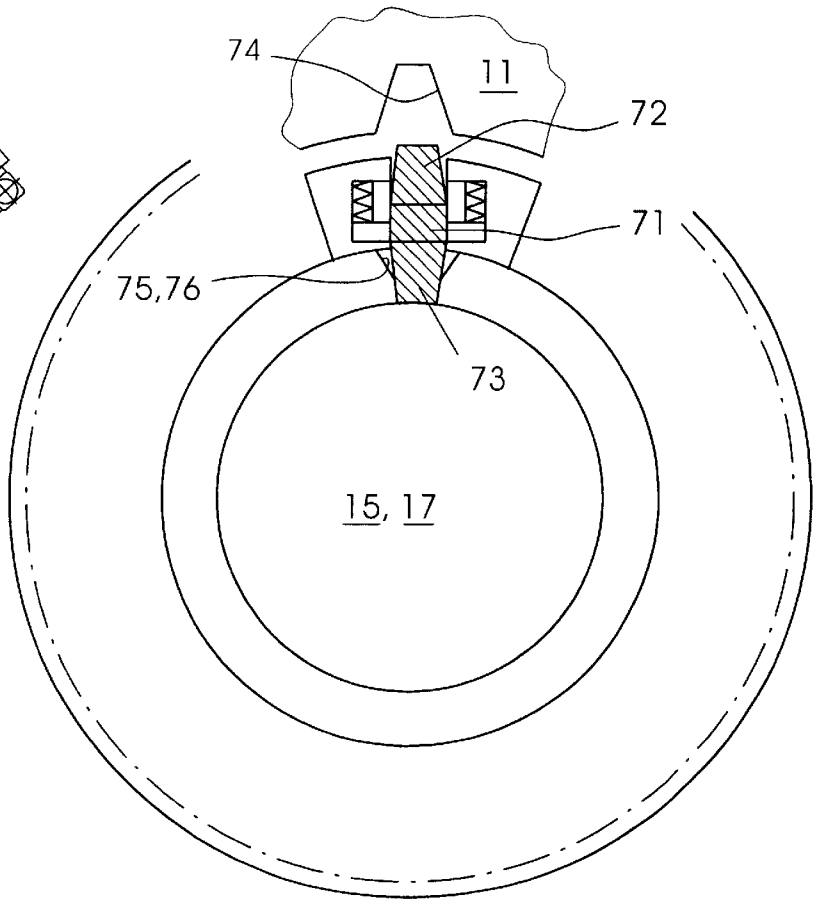
FIG. 14 is an enlarged, fragmentary, cross-sectional view of form-fitting elements of the sheet-fed rotary printing machine of FIG. 12.

In the fifth variant illustrated in FIGS. 12 and 14, the operation of retaining the circumferential register takes place, in the same manner as with the variant illustrated in FIGS. 11 and 13, by the interaction of the oblique toothing formation between the driving gearwheel 14 and the actuating gearwheel 15 with a straight toothing formation 79 between the actuating element 17 and the cylinder 13. In the fifth variant of FIG. 12, the operation of switching over between the coupling and fixing positions is achieved by an actuating member 71, on which a first form-fitting element 72 and a second form-fitting element 73 are formed on opposite sides with respect to one another. The first form-fitting element 72 can engage in a recess 74 that is formed on the framework 11. The second form-fitting element 73 engages simultaneously in a recess 75 in the actuating element 17 and in a recess 76 in the actuating gearwheel 15, the configuration providing a form-fitting connection between the actuating gearwheel 15 and the actuating element 17. The actuating member 71 can be moved back and forth in the radial direction, in relation to the cylinder 13, by an actuating motor or a pneumatic cylinder 77.

FIG. 14 is an enlarged, side view of the actuating member 71. As in FIG. 12, the actuating member 71 is located in a coupling position, in which the form-fitting element 73 ensures a form-fitting connection between the actuating gearwheel 15 and the actuating element 17. The actuating member 71 is prestressed in the position by springs. In the event of an auxiliary-power failure, the actuating member 71 is retained in the position shown in FIGS. 12 and 14 due to the spring prestressing force. Such retention prevents undesired disengagement.

Figure 15:
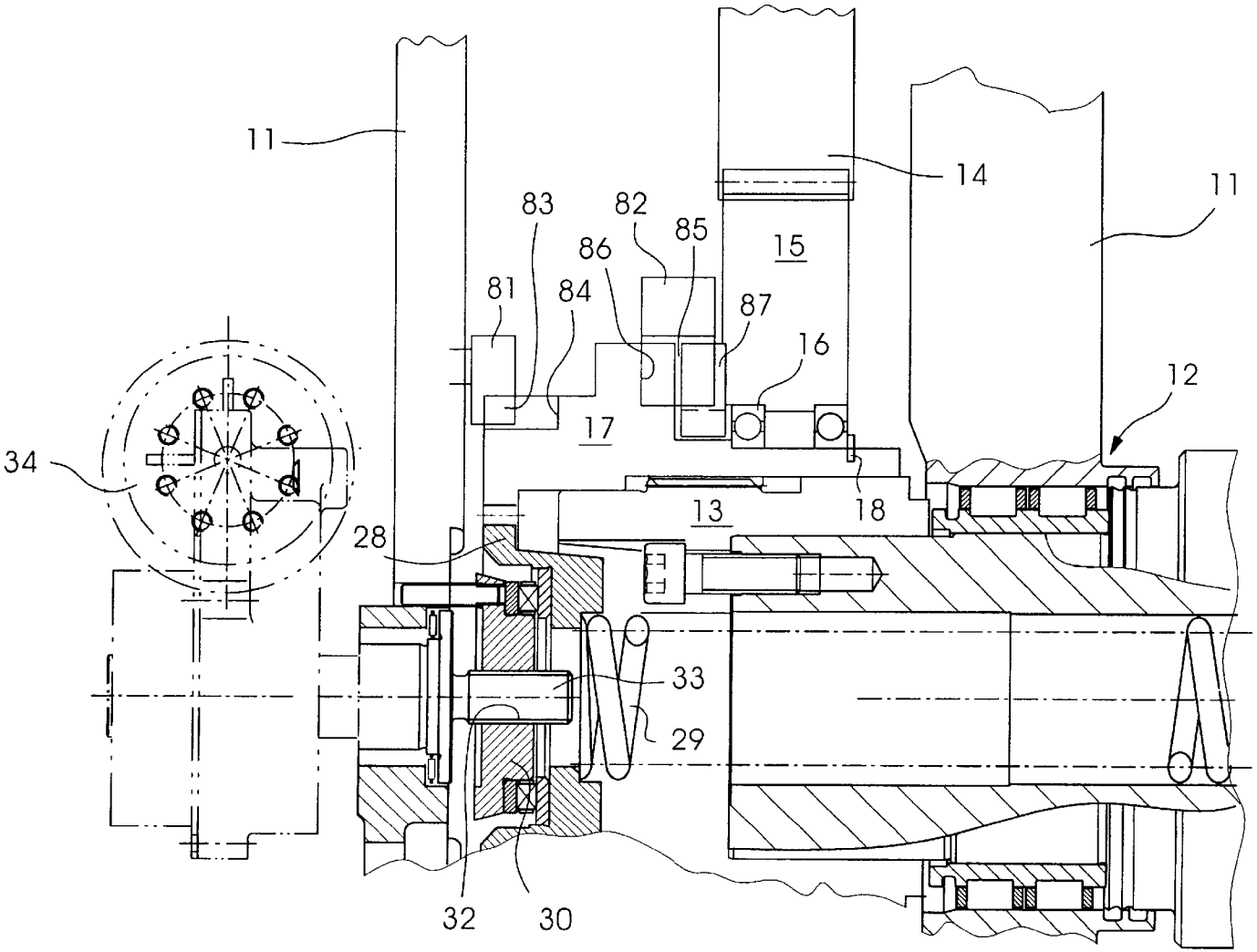
FIG. 15 is a fragmentary, cross-sectional view of a sixth embodiment of the sheet-fed rotary printing machine of FIG. 1.

The sixth variant illustrated in FIG. 15, is similar to the first variant illustrated in FIG. 2. Accordingly, the same parts are provided with the same designations. Thus, reference is made to the description relating to FIG. 2 for such parts. To avoid repetition, only the differences between the two variants are discussed below.

In the sixth variant, the operation of retaining the circumferential register takes place in the same way as for the preceding variants, namely by axial displacement of the actuating element 17. In the sixth variant of FIG. 15, the operation of switching over between the coupling and fixing positions takes place by adjustment of a first additional actuating element 81 and of a second additional actuating element 82. A form-fitting element 83 is formed on the first additional actuating element 81. The form-fitting element 83 engages in a recess 84 that is provided on the actuating element 17. The second additional actuating element 82 has a form-fitting element 85, which engages both in a recess 86 in the actuating element 17 and a recess 87 in the actuating gearwheel 15 to connect the latter to the actuating element 17 in a form-fitting manner.

In all the variants, only a single angle position is admissible between the cylinder 13 and the driving gearwheel 14. However, in the case of a half-revolution or third-revolution cylinder, two or three positions, respectively, are also, of course, conceivable. The same applies to the operation of fixing the cylinder 13 relative to the framework 11. In the case of a half-revolution or third-revolution cylinder, two or three positions, respectively, are conceivable here as well.

We claim:

1. A method of operating a sheet-fed rotary printing machine, which comprises:

mounting at least one rotating cylinder to be selectively coupled to a drive and fixed relative to a framework;

moving an actuator to both uncouple the cylinder from the drive and fix the cylinder relative to the framework; and rotating the cylinder in a circumferential direction by moving the actuator.

2. The method according to claim 1, wherein the actuator is one of the group consisting of an actuating element and an actuating member.

3. The method according to claim 1, which further comprises rotating the cylinder in a circumferential direction by displacement of the actuator parallel to a longitudinal axis of the cylinder.

4. A sheet-fed rotary printing machine, comprising:

a framework;

a drive having a gearwheel;

a first cylinder being an impression cylinder;

a second cylinder cooperably associated with said first cylinder and rotatably mounted to said framework, said second cylinder having a longitudinal axis;

a fixing and coupling configuration connected to said second cylinder to both uncouple said second cylinder from said drive and fix said second cylinder relative to said framework, said second cylinder being selectively coupled to said drive and fixed relative to said framework, said fixing and coupling configuration having an actuating element mounted displaceably parallel to said longitudinal axis; and an actuating gearwheel being axially fixed and mounted rotatably on said actuating element coaxially with said second cylinder, said actuating gearwheel engaging said driving gearwheel.

5. The sheet-fed rotary printing machine according to claim 4, wherein said actuating element is displaceable axially between:

a coupling position, in which said cylinder is coupled to said driving gearwheel; and a fixing position, in which said cylinder is fixed relative to said framework.

6. The sheet-fed rotary printing machine according to claim 5, including a first form-fitting element, said actuating gearwheel being directly form-fittingly connected to said cylinder through said first form-fitting element in said coupling position of said actuating element.

7. The sheet-fed rotary printing machine according to claim 6, wherein:

said cylinder has an arm with an end having a bore;

said first form-fitting element is a bolt fitted on said actuating gearwheel and, in said coupling position of said actuating element, is at least partially accommodated in said bore.

8. The sheet-fed rotary printing machine according to claim 7, wherein said bolt has a bevel formed thereon.

9. The sheet-fed rotary printing machine according to claim 6, including a spring, an actuating member movable relative to said actuating element between a coupling position and a fixing position of said cylinder, said actuating gearwheel having a bore, said first form-fitting element being a bolt prestressed by said spring, fitted on said actuating member, and, in said coupling position of said actuating member, being at least partially accommodated in said bore.

10. The sheet-fed rotary printing machine according to claim 9, wherein said bolt has a bevel formed thereon.

11. The sheet-fed rotary printing machine according to claim 6, including a second form-fitting element connecting said actuating element to said framework in said fixing position.

12. The sheet-fed rotary printing machine according to claim 11, wherein:

said framework has bore; and said second form-fitting element is a bolt disposed on said actuating element and, in said fixing position of said actuating element, is at least partially accommodated in said bore of said framework.

13. The sheet-fed rotary printing machine according to claim 12, wherein said bolt has a bevel formed thereon.

14. The sheet-fed rotary printing machine according to claim 5, including a further actuating element fixing said cylinder relative to said framework.

15. The sheet-fed rotary printing machine according to claim 14, wherein:

said cylinder has an arm with a recess;

said further actuating element is a slide guided on said framework and at least partially engages in said recess to fix said cylinder.

16. The sheet-fed rotary printing machine according to claim 15, wherein said further actuating element is radially displaceable and is resiliently mounted in a tangential direction with respect to said cylinder.

17. The sheet-fed rotary printing machine according to claim 14, wherein said further actuating element is radially displaceable and is resiliently mounted in a tangential direction with respect to said cylinder.

18. The sheet-fed rotary printing machine according to claim 4, including an actuating member movable relative to said actuating element, said actuating member being displaceable axially between:

a coupling position, in which said cylinder is coupled to said driving gearwheel; and a fixing position, in which said cylinder is fixed relative to said framework.

19. The sheet-fed rotary printing machine according to claim 10, including a first form-fitting element, said actuating gearwheel being form-fittingly connected to said cylinder, through said first form-fitting element, indirectly through said actuating element in said coupling position of said actuating member.

20. The sheet-fed rotary printing machine according to claim 19, including a second form-fitting element connecting said actuating element to said framework in said fixing position.

21. The sheet-fed rotary printing machine according to claim 20, wherein:

said framework has bore; and said second form-fitting element is a bolt disposed on said actuating member and, in said fixing position of said actuating member, is at least partially accommodated in said bore of said framework.

22. The sheet-fed rotary printing machine according to claim 21, wherein:

said second form-fitting element is connected to said first form-fitting element; and a latching configuration retains said second form-fitting element on said framework in said fixing position of said actuating member.

23. The sheet-fed rotary printing machine according to claim 22, wherein said second form-fitting element is integral with said first form-fitting element.

24. The sheet-fed rotary printing machine according to claim 4, including an actuating member mounted on said actuating element, said actuating member having:

a first form-fitting element; and a second form-fitting element, said actuating member moveable between a coupling position, in which said cylinder is connected to said actuating gearwheel in a rotationally fixed manner through said first form-fitting element, and a fixing position, in which said cylinder is connected to said framework in a rotationally fixed manner through said second form-fitting element.

25. The sheet-fed rotary printing machine according to claim 24, wherein:

an actuating configuration has an actuated state and a non-actuated state and is connected to and actuates said actuating member; and a prestressed spring retains said actuating member in one of said coupling position and said fixing position in said non-actuated state of said actuating configuration.

26. The sheet-fed rotary printing machine according to claim 24, wherein:

said actuating member is a lever pivotably connected to said actuating element;

said lever has an end; and said first form-fitting element and said second form-fitting element are disposed at said end on opposite sides with respect to one another.

27. The sheet-fed rotary printing machine according to claim 24, wherein said actuating member is a slide displaceably guided relative to said actuating element.

28. The sheet-fed rotary printing machine according to claim 4, wherein said fixing and coupling configuration has:

a first additional actuating element selectively fixing said actuating element relative to said framework; and a second additional actuating element selectively coupling said actuating element to said actuating gearwheel.

29. The sheet-fed rotary printing machine according to claim 28, wherein:

said actuating element has at least one recess;

said actuating gearwheel has a recess;

said first additional actuating element has a first form-fitting element;

said second additional actuating element has a second form-fitting element; and said first and second form-fitting elements are each accommodated in at least one of the group consisting of said at least one recess and said recess.

30. The sheet-fed rotary printing machine according to claim 4, including a form-fitting element connecting said actuating element to said cylinder in a rotationally fixed manner.

31. The sheet-fed rotary printing machine according to claim 30, wherein said form-fitting element is one of the group consisting of a feather key, a toothing formation, and a straight toothing formation.

32. The sheet-fed rotary printing machine according to claim 4, wherein said actuating gearwheel and said driving gearwheel each have an oblique toothing formation.

33. The sheet-fed rotary printing machine according to claim 4, including:

a motor; and a threaded bolt rotatably driven by said motor; and wherein:

said framework has a flange with a threaded bore;

said threaded bolt is accommodated in said threaded bore;

said fixing and coupling configuration is an actuating element; and said actuating element is connected to said threaded bolt.

34. The sheet-fed rotary printing machine according to claim 33, wherein said threaded bolt has a self-locking thread.

35. The sheet-fed rotary printing machine according to claim 4, wherein:

said fixing and coupling configuration is an actuating element; and a spring is connected to said actuating element and prestresses said actuating element.

36. The sheet-fed rotary printing machine according to claim 4, including a clamping gearwheel bracing said actuating gearwheel with respect to said driving gearwheel.

* * * * *